US007766180B2

(12) United States Patent
Mansouri et al.

(10) Patent No.: US 7,766,180 B2
(45) Date of Patent: Aug. 3, 2010

(54) COLLAPSIBLE BULK CAGE LINER

(75) Inventors: James Mansouri, Sealy, TX (US); Peter Apostoluk, Delaware, OH (US); Eric Nelson, Lavonia, GA (US)

(73) Assignee: Greif, Inc., Delaware, OH (US)

( * ) Notice: Subject to any disclaimer, the term of this patent is extended or adjusted under 35 U.S.C. 154(b) by 367 days.

(21) Appl. No.: 11/898,692

(22) Filed: Sep. 14, 2007

(65) Prior Publication Data

US 2008/0067176 A1 Mar. 20, 2008

Related U.S. Application Data

(60) Provisional application No. 60/845,251, filed on Sep. 18, 2006.

(51) Int. Cl.
*G05D 21/02* (2006.01)
*G05D 3/00* (2006.01)

(52) U.S. Cl. ..... 220/23.9; 220/495.01; 229/117.3

(58) Field of Classification Search ..... 220/1.6, 220/9.4, 23.9, 495.01, 495.05, 495.06; 229/117.3, 229/117.35, 122.33–122.35
See application file for complete search history.

(56) References Cited

U.S. PATENT DOCUMENTS

| | | | | |
|---|---|---|---|---|
| 4,786,192 | A * | 11/1988 | Graves et al. | 383/119 |
| 6,223,903 | B1 * | 5/2001 | Mansouri | 206/600 |
| 6,454,113 | B1 * | 9/2002 | Schutz | 220/1.6 |
| 7,607,564 | B2 * | 10/2009 | Churvis et al. | 229/117.3 |
| 2005/0051611 | A1 * | 3/2005 | Ingalls | 229/117.3 |

* cited by examiner

*Primary Examiner*—Anthony Stashick
*Assistant Examiner*—Harry A Grosso
(74) *Attorney, Agent, or Firm*—Baker & Hostetler LLP

(57) ABSTRACT

A liner cassette for use with an existing intermediate bulk container includes a box and a liner. The box is configured to unfold within the intermediate bulk container and the liner is configured to fit within the box. The liner cassette includes two configurations. In a first configuration, the box and liner may be folded substantially flat to facilitate transportation. In a second configuration, the box and liner are configured to provide a liquid containment system for the existing intermediate bulk container.

16 Claims, 10 Drawing Sheets

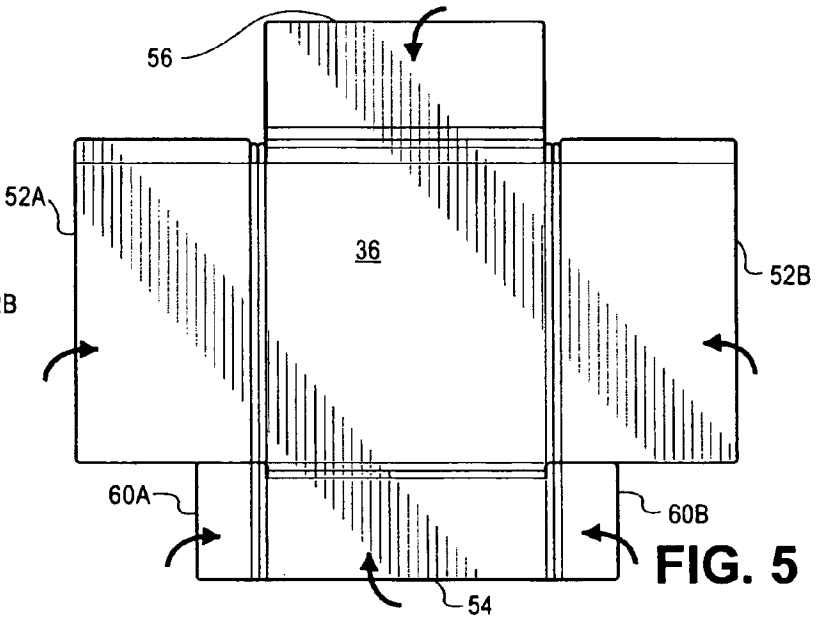
FIG. 5
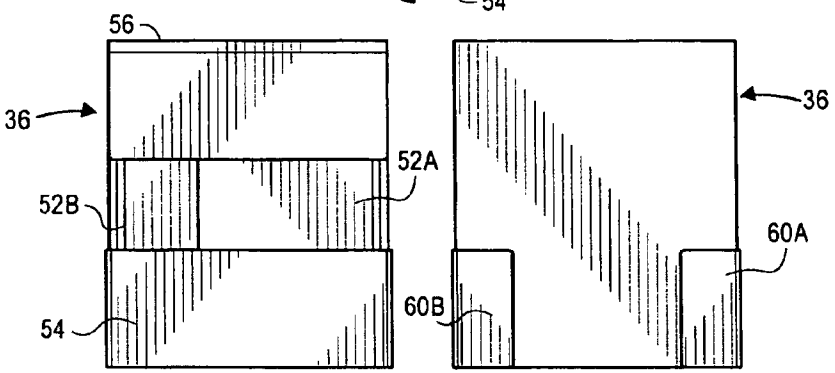
FIG. 7
FIG. 6
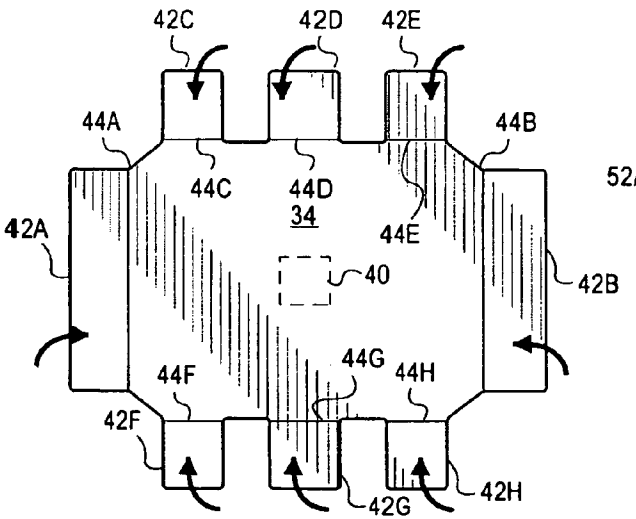
FIG. 3
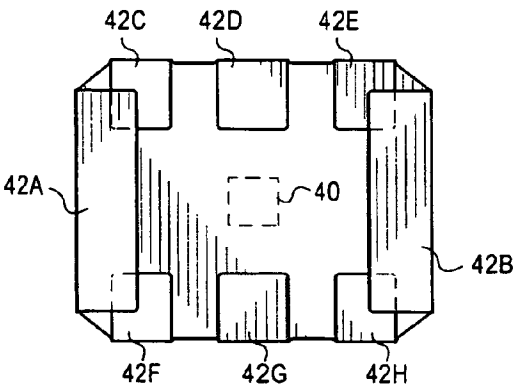
FIG. 4

COLLAPSIBLE BULK CAGE LINER

CROSS REFERENCE TO RELATED APPLICATIONS

This application claims priority to U.S. Provisional Application Ser. No. 60/845,251, filed on Sep. 18, 2006, titled "INTERMEDIATE BULK CONTAINER PACKAGING SYSTEM AND METHOD," the disclosure of which is incorporated herein by reference in its entirety.

FIELD OF THE INVENTION

The present invention generally relates to intermediate bulk containers. More particularly, the present invention pertains to a liner for use with an intermediate bulk container and a method of installing the liner in the intermediate bulk container.

BACKGROUND OF THE INVENTION

Intermediate bulk containers ("IBC") are widely utilized to transport, store and dispense goods. In particular, IBCs are utilized to contain liquid goods. IBCs generally include a cage or other such rigid walls and, to contain liquid goods, IBCs typically include a rigid plastic bottle that is placed within the cage. These bottles may be replaced when they become soiled or leaky.

Unfortunately, conventional IBC bottles are relatively bulky to ship. Other disadvantages associated with conventional IBC bottles are their weight and expense. Accordingly, it is desirable to provide an IBC cage liner that is capable of overcoming the disadvantages described herein at least to some extent.

SUMMARY OF THE INVENTION

The foregoing needs are met, to a great extent, by the present invention, wherein in some embodiments an intermediate bulk container ("IBC") packaging system is provided.

An embodiment of the present invention relates to a liner cassette to line a cage of an intermediate bulk container. The liner cassette includes a liner and a box. The liner includes an envelope and a spout. The envelope is configured to contain a product. The spout is configured to provide access to the envelope. The box includes a set of sheet stock panels. The set of sheet stock panels include a bottom panel, a plurality of side panels, a plurality of fold zones, and a spout access. The plurality of fold zones is configured to conform to a radiused edge disposed between two side panels of the plurality of side panels. The spout access is disposed in a panel of the plurality of side panels. The liner cassette includes a first conformation and a second conformation. The first conformation is substantially flat with the set of sheet stock panels folded one upon the other and the liner is disposed between the folded set of sheet stock panels. The second conformation is substantially conformal to an interior of the cage.

Another embodiment of the present invention pertains to a packaging system. The packaging system includes an intermediate bulk container and a liner cassette. The intermediate bulk container includes a cage having a set of walls and a floor. The liner cassette is configured to line the cage. The liner cassette includes a liner and a box. The liner includes an envelope and a spout. The envelope is configured to contain a product. The spout is configured to provide access to the envelope. The box includes a set of sheet stock panels. The set of sheet stock panels include a bottom panel, a plurality of side panels, a plurality of fold zones, and a spout access. The plurality of fold zones is configured to conform to a radiused edge disposed between two side panels of the plurality of side panels. The spout access is disposed in a panel of the plurality of side panels. The liner cassette includes a first conformation and a second conformation. The first conformation is substantially flat with the set of sheet stock panels folded one upon the other and the liner is disposed between the folded set of sheet stock panels. The second conformation is substantially conformal to an interior of the cage.

Yet another embodiment of the present invention relates to a method of replacing a liner cassette in a cage of an intermediate bulk container. In this method, a flat-packed liner cassette is disposed in the cage and the flat-packed liner cassette is unfolded to substantially conform to the interior of the cage. The liner cassette includes a liner and a box. The liner includes an envelope and a spout. The envelope is configured to contain a product. The spout is configured to provide access to the envelope. The box includes a set of sheet stock panels. The set of sheet stock panels include a bottom panel, a plurality of side panels, a plurality of fold zones, and a spout access. The plurality of fold zones is configured to conform to a radiused edge disposed between two side panels of the plurality of side panels. The spout access is disposed in a panel of the plurality of side panels. The liner cassette includes a first conformation and a second conformation. The first conformation is substantially flat with the set of sheet stock panels folded one upon the other and the liner is disposed between the folded set of sheet stock panels. The second conformation is substantially conformal to an interior of the cage.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 3 is a plan view of the pre-cut and pre-scored blank suitable for use in a cover according to an embodiment of the invention.

FIG. 4 is a plan view of a folded blank suitable for use in the cover according to FIG. 3.

FIG. 5 is a plan view of the pre-cut and pre-scored blank suitable for use in a side unit according to an embodiment of the invention.

FIG. 6 is a plan view of a front side of the folded blank suitable for use in the side unit according to FIG. 5.

FIG. 7 is a plan view of a back side of the folded blank suitable for use in the side unit according to FIG. 5.

DETAILED DESCRIPTION

The present invention provides, in some embodiments, an intermediate bulk container ("IBC") liner packaging system, a method of generating a replacement liner cassette for the packaging system, and a method of installing the liner cassette in the packaging system. For the purpose of this disclosure, a box or container is defined as a receptacle or cover to enclose or partially enclose an item. Also for the purpose of this disclosure, a liner is defined as a membrane, envelope, or bag for retaining liquid contents. In an embodiment, the invention provides a liner cassette that includes a box and liner for use in an existing IBC cage. The liner cassette may be folded or collapsed to facilitate transport The box may include any suitable sheet stock such as, for example, fiberboard, corrugated fiberboard, corrugated plastic or plastic composite, metals, fabrics, composites, and the like. For the purpose of this disclosure, the term, "fiberboard" is defined as at least including, for example, paper, paperboard, cardboard, corrugated cardboard, cellulosic, fiberglass, carbon fiber, spun ceramic fibers such as silica-alumina ceramic, and/or resinous material which is similar in character to fiberboard, and which is manipulated in the same or similar manner as fiberboard. This includes any suitable material capable of being folded from a blank. In this regard, the term "blank" refers to at least a piece or unit of fiberboard that is cut or scored and/or suitable for folding into a particular conformation such as a box, lid, or tube.

In another embodiment, the invention provides for a method of generating a replacement liner cassette for the packaging system. In this method, the various components of the liner cassette may be assembled and packaged or "flat-packed" for transport.

In yet another embodiment, the invention provides for a method of installing the liner cassette in the packaging system. In this method, the flat-packed liner cassette may be placed in an existing IBC and unfolded or assembled.

Figure 1:
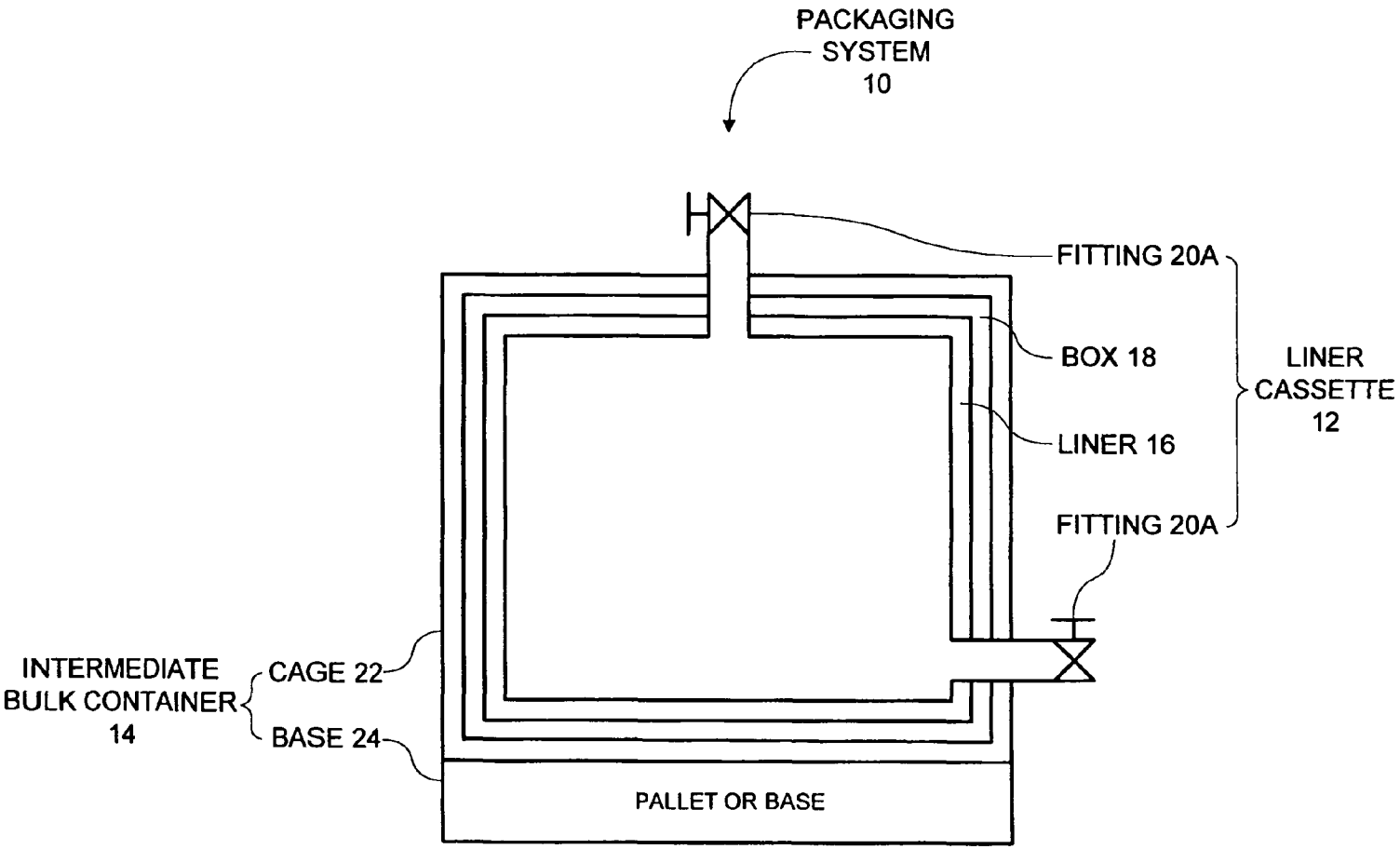
FIG. 1 is a block diagram of an intermediate bulk container ("IBC") system according to an embodiment of the invention.

The invention will now be described with reference to the drawing figures, in which like reference numerals refer to like parts throughout. As shown in FIG. 1, a intermediate bulk container ("IBC") liner packaging system 10 includes a liner cassette 12 for use in an existing IBC 14. The liner cassette 12 includes a liner 16, box 18, and one or more fittings 20A and 20B. The IBC 14 includes a cage 22 and a pallet or base 24.

The liner 16 includes any suitable material such as, for example, polyethylene, polypropylene, plastic, rubber, and the like. In various forms, the liner 16 may be flexible and/or may be folded substantially flat to reduce a volume of air contained therein. In a particular example, the liner 16 may include a Food and Drug Administration ("FDA") approved material for use with food. In another particular example, the liner 16 may be suitable to store and/or transport hazardous and/or Department of Transportation (DOT) regulated liquids.

The box 18 may include any suitable material or combination of materials. In general, suitable materials include various sheet stock or the like. Particular examples of suitable materials include corrugated cardboard (coated and uncoated) and corrugated plastic panels. The box 18 may include a floor, sidewalls, and a lid. In a particular example, the liner 16 may be attached to the floor. For storage and transport of the liner cassette 12, the sidewalls and lid may be folded down or stacked upon the floor and line 16 to generate a de-bulked configuration or "flat pack." In this flat pack form, the liner cassette 12 may be relative easily transported and/or stored. For example, about 800 liner cassettes 12 may be transported in a standard tractor trailer.

Optionally, the liner cassette 12 may include the fittings 20*a* and 20*b*. In various forms the fittings 20*a* and 20*b* include any suitable fitting such as, for example, caps, adapters, valves, and the like. If included, the fittings 20*a* and 20*b* may facilitate filling and/or dispensing contents into and/or out of the packaging system 10.

Figure 2:
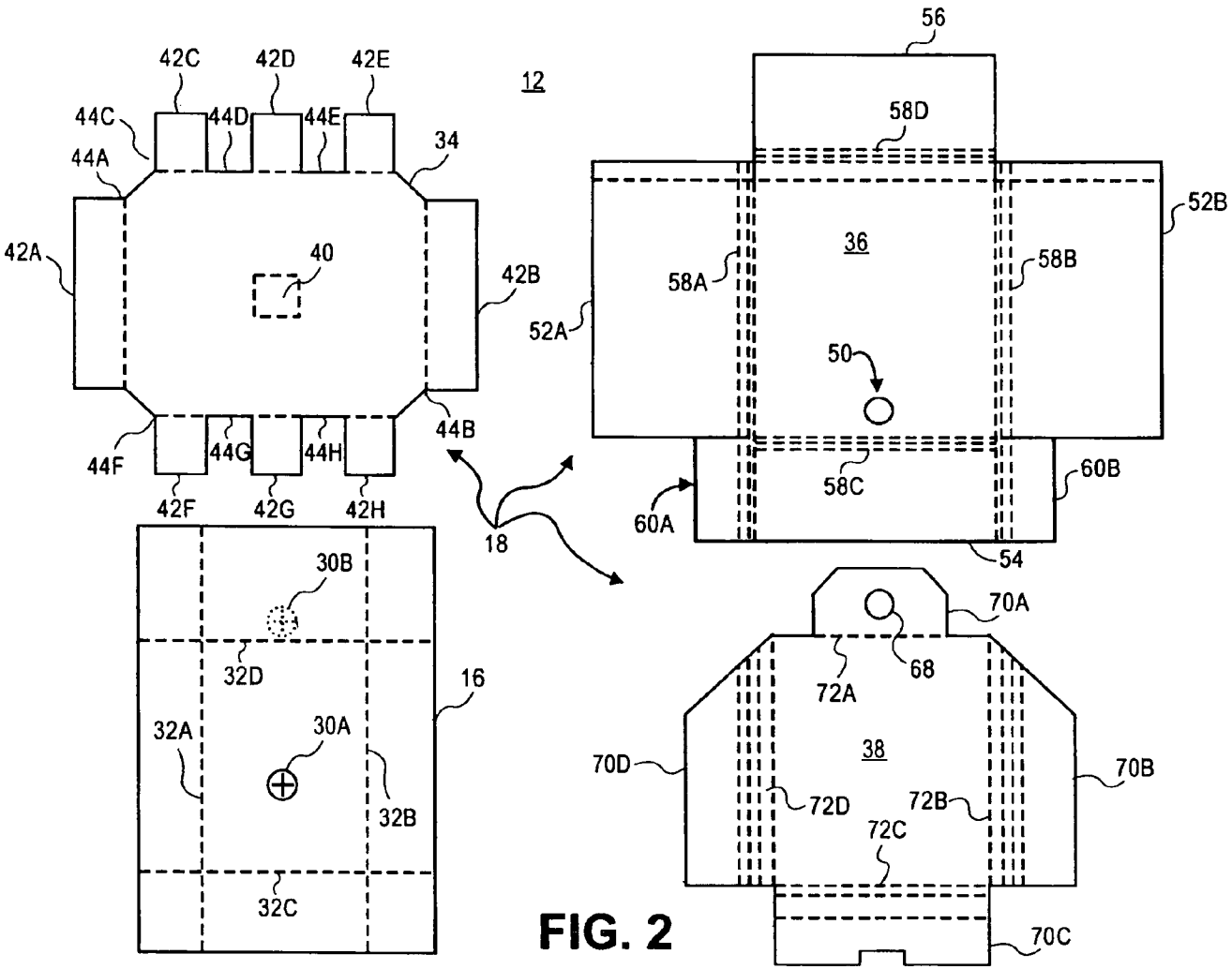
FIG. 2 is a plan view of components suitable for use in a liner cassette according to FIG. 1.

FIG. 2 is a plan view of components suitable for use in the liner cassette 12 according to FIG. 1. As shown in FIG. 2, the liner cassette 12 includes the liner 16 and a plurality of pre-cut and pre-scored blanks suitable for assembling the box 18. The liner 16 includes a spout 30A and/or a spout 30B configured to mate with the fittings 20A and 20B. The liner 16 may be folded during assembly of the liner cassette 12. For example, the liner 16 may be along fold lines 32A to 32D. In other examples the liner 16 may have more or fewer spouts and may be folded in any suitable manner for storage, packaging and/or distribution.

The pre-cut and pre-scored blanks suitable for assembling the box 18 may include, for example a cover 34, one or more side units 36, and bottom unit 38. The cover 34 is optionally included to cover or otherwise protect the liner 16 and/or the packaging system 10. If included, the cover 34 optionally includes a spout access 40. The spout access 40 may include a "knock out" section disposed to align with the spout 30A in the assembled packaging system 10. For example, the spout access 40 may be partially perforated to facilitate removal. The cover 34 further includes a set of tabs 42A to 42H that may be folded along a corresponding set of fold lines 44A to 44H. The fold lines 44A to 44H may be scored, pre-stressed, and/or pre-folded to facilitate folding the tabs 42A to 42H relative to the cover 34. In an embodiment, the tabs 42A to 42H are folded at about 90° to the cover 34 and inserted between the cage 22 and the box 18 or liner 16. In this manner, the cover 34 may be secured to the packaging system 10.

The one or more side units 36 include at least one spout access 50. In a particular example, two side units 36 are utilized and one or both may include the spout access 50. In the assembled packaging system, the spout access 50 is disposed in cooperative alignment with the fitting 20B. As shown in FIG. 2, the side unit 36 includes side panels 52A and 52B, bottom panel 54, and top panel 56. The side panels 52A and 52B are configured to fold along a plurality of fold zones 58A and 58B, respectively. The bottom panel 54 is configured to fold along a fold zone 58C. The top panel 56 is configured to fold along a fold zone 58D. Some or all of the fold zones 58A-58D are configured to fold or bend accommodate a variety of curvatures. For example, the fold zones 58A-58D may bend along an arcuate or radiused corner having a radius from about ¼ inch to about 1 foot or more. In a particular example, the cage 22 may include corners that curve with a radius of about 6 inches and the fold zones 58A-58D. To accommodate various curvatures, each fold zone of the fold zones 58A-58D may include a plurality of score lines running parallel to the fold zone. In this manner, the fold zone 58A-58D may generate a plurality of facets as the panels are bent and the side unit 36 is assembled in the cage 22. Optionally, the side unit 36 may include tabs 60A and 60B.

The bottom unit 38 includes a spout access 68. In the assembled packaging system, the spout access 68 is disposed in cooperative alignment with the fitting 20B. The bottom unit 38 further includes a plurality of retaining tabs 70A to 70D that are configured to fold along fold zones 72A to 72D. As shown and described hereinafter, the bottom unit 38 is configured to provide an envelope for the liner 16 during shipping and/or storage. The bottom unit 38 is further configured to provide a supporting surface on the bottom of the cage 22 when the liner cassette 12 is assembled. In this regard, the bottom unit 38 may be configured to cover at least a portion of the bottom of the cage 22.

FIGS. 3 to 7 show a folded configuration of the pre-cut, pre-scored blanks for the cover 34 and side unit 36. FIG. 3 is a plan view of the pre-cut and pre-scored blank suitable for use in the cover 34. As shown in FIG. 3, the tabs 42A to 42H are folded up and out of the plane of the cover 34 as indicated by the arrows. FIG. 4 is a plan view of a folded blank suitable for use in the cover 34. As shown in FIG. 4, the tabs 42A to 42H are folded inward and down upon the cover 34.

FIG. 5 is a plan view of the pre-cut and pre-scored blank suitable for use in the side unit 36. As shown in FIG. 5, the side panels 52A and 52B, bottom panel 56, and top panel 56 of the side unit 36 are folded upwards and inwards out of the plane of the side unit 36 and then inwards and downwards upon the side unit 36. FIG. 6 is a plan view of a front side of the folded blank suitable for use in the side unit 36. As shown in FIGS. 6 and 7, the various panels of the side unit 36 nest and overlap to generate a substantially smaller package that is suitable for transport and storage. FIG. 7 is a plan view of a back side of the folded blank suitable for use in the side unit 36. As shown in FIG. 7, the tabs 60A and 60B may be wrapped around the side unit 36.

Figure 9:
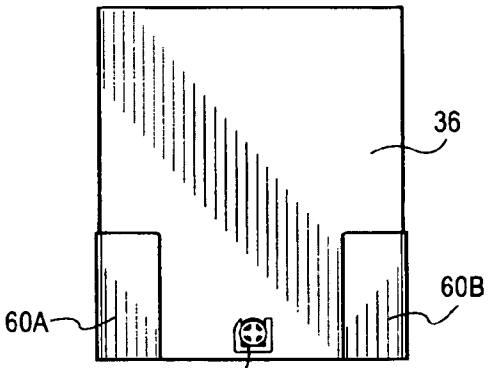
FIG. 9 is a plan view of a back side of the liner, side unit, and a bottom unit folded according to an embodiment of the invention.
Figure 10:
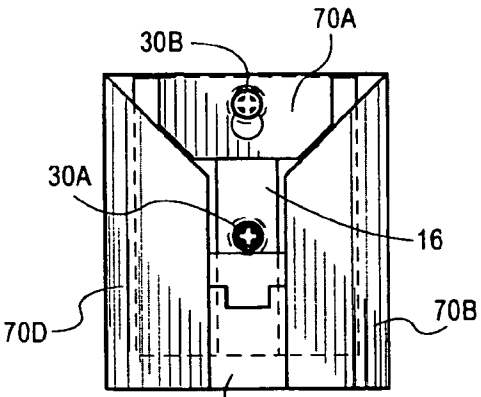
FIG. 10 is a plan view of a front side of the liner, side unit, and bottom unit folded according to an embodiment of the invention.
Figure 8:
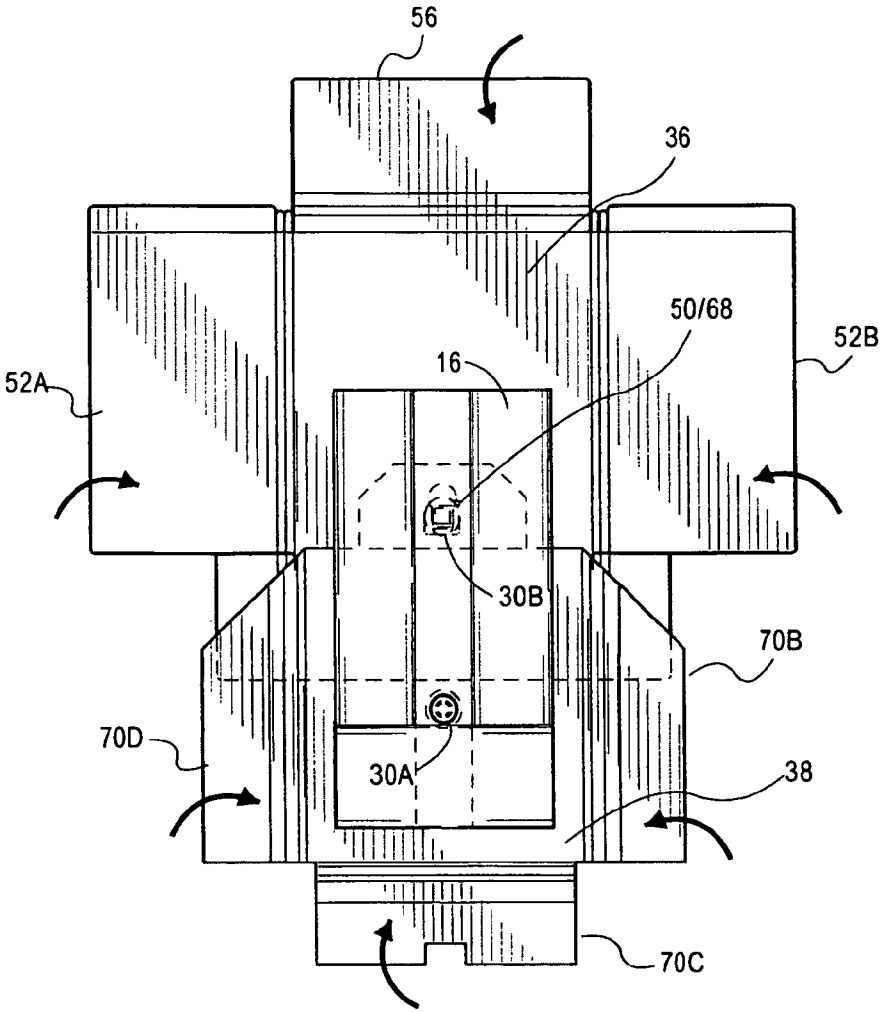
FIG. 8 is a plan view of a partially assembled liner cassette suitable for use in the IBC liner packaging system of FIG. 1.

FIG. 8 is a plan view of a partially assembled liner cassette 12 suitable for use in the IBC liner packaging system 10 of FIG. 1. As shown FIG. 8, the bottom unit 38 is disposed upon the side unit 36 with the spout access 68 in cooperative alignment with the spout access 50. In addition, the spout 30B may be disposed in the access formed by the spout access 50 and 68. The partially folded liner 16 may be aligned as shown. According to an embodiment, to prepare the cassette liner 12 for storage and/or transport, the side panels 52A and 52B and the top panel 56 may be folded upon the liner 16 as shown in FIG. 8. The bottom unit 38 may be folded upon the side unit 36. In addition, the retaining tabs 70B to 70D may be folded around the side unit 36 as indicated by the arrows shown in FIG. 8. FIG. 9 is a plan view of a back side of the liner 16, side unit 36, and bottom unit 38 folded according to an embodiment of the invention. As shown in FIG. 9, the tabs 60A and 60B may be wrapped around the side unit 36. As shown in FIGS. 9 and 10, the various panels of the side unit 36 and bottom unit 38 nest and overlap to generate a substantially smaller package that is suitable for transport and storage. FIG. 10 is a plan view of a front side of the liner 16, side unit 36, and bottom unit 38 folded according to an embodiment of the invention.

To install the liner cassette in the cage 22, folded components such as those shown in FIG. 9 are placed in the cage 22 and the spout 30B is aligned with the appropriate location on the cage 22. The side panels 52A and 52B may be unfolded against the sides of the cage 22 and the bottom unit 38 is unfolded on to the bottom of the cage 22. Another side unit 36 may be installed on the side of the cage 22 opposite from the side where the first side unit 36 was installed. Again, the side panels 52A and 52B are unfolded against the sides of the cage 22 and generally overlap the respective side panels 52A and 52B from the previously installed side unit 36. The spout 30A may be accessed and filled with a fill hose, for example. Optionally, the cover 34 may be installed to cover the liner 16.

Figure 12:
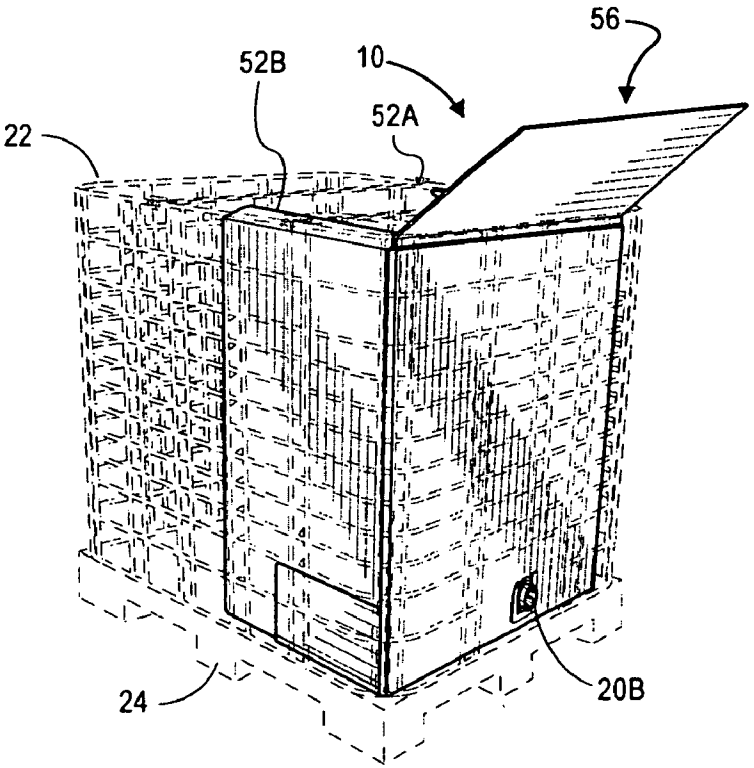
FIG. 12 is a perspective view of a partially assembled IBC liner packaging system illustrating the liner cassette in a partially unfolded configuration according to an embodiment of the invention.
Figure 11:
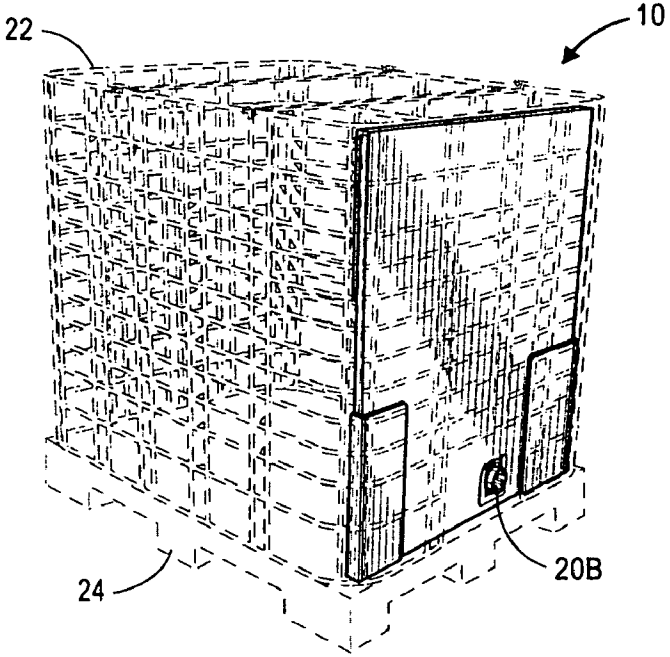
FIG. 11 is a perspective view of a partially assembled IBC liner packaging system illustrating the placement of a flat-packed liner cassette in a cage of the IBC according to an embodiment of the invention.
Figure 14:
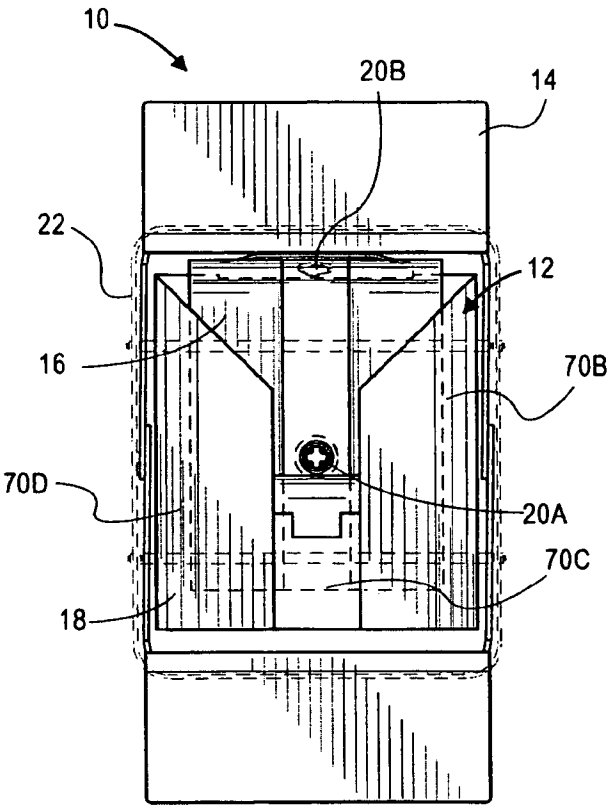
FIG. 14 is a top view looking into the partially assembled liner cassette.
Figure 13:
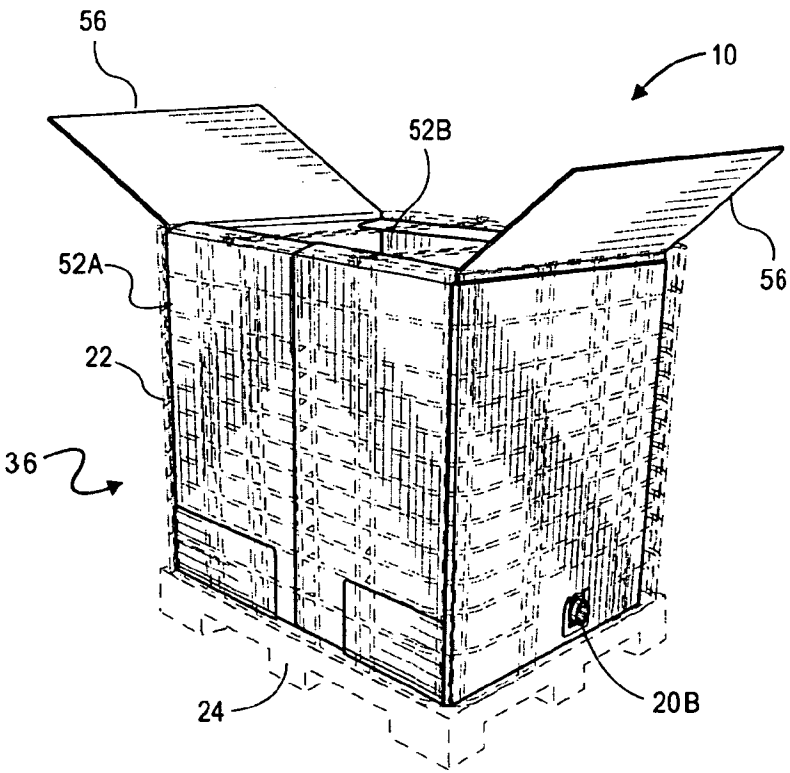
FIG. 13 is a perspective view of a partially assembled IBC liner packaging system illustrating the liner cassette with a second side unit in an unfolded configuration according to an embodiment of the invention.

FIGS. 11 to 16 show steps suitable for installing the liner cassette 12 in the cage 22. As shown in FIG. 11, a folded or compact conformation of the liner cassette 12 may be slid into place in the cage 22 with the spout 30B appropriately disposed. The side panels 52A and 52B may be folded outwardly and the top panel 56 may be folded upwardly as shown in FIG. 12. In FIG. 13 another side unit 36 is shown installed with the respective side panels 52A and 52B and top panel 56 unfolded. FIG. 14 is a top view looking into the partially assembled liner cassette 12. As shown in FIG. 14, the spout 30A may be accessed by reaching into the cage 22 and attaching a fill hose thereto, for example. The retaining tabs 70B-70D unfold into place in response to filling the liner 16.

Figure 15:
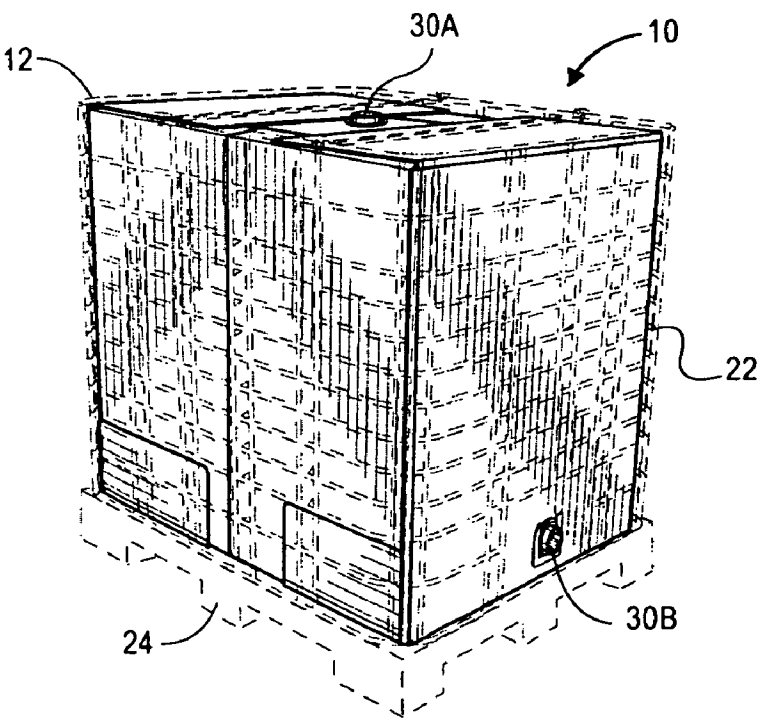
FIG. 15 is a perspective view of the liner cassette installed in the cage.

FIG. 15 is a perspective view of the liner cassette 12 installed in the cage 22. As shown in FIG. 15, the various components of the box 18 fully cover the inside of the cage 22 and provide a barrier between the liner 16 and cage 22. In this manner, the liner 16 is protected from abrasion and/or puncture. It is another advantage that the box 18 provides a degree of thermal protection for the liner 16. It is yet another advantage of various embodiments that, due to the overlapping components, the box 18 is configured to accommodate cages 22 of different sizes. Furthermore, the sliding overlapping components are configured to facilitate expansion and contraction with thermal and load induced changes in size and shape.

Figure 16:
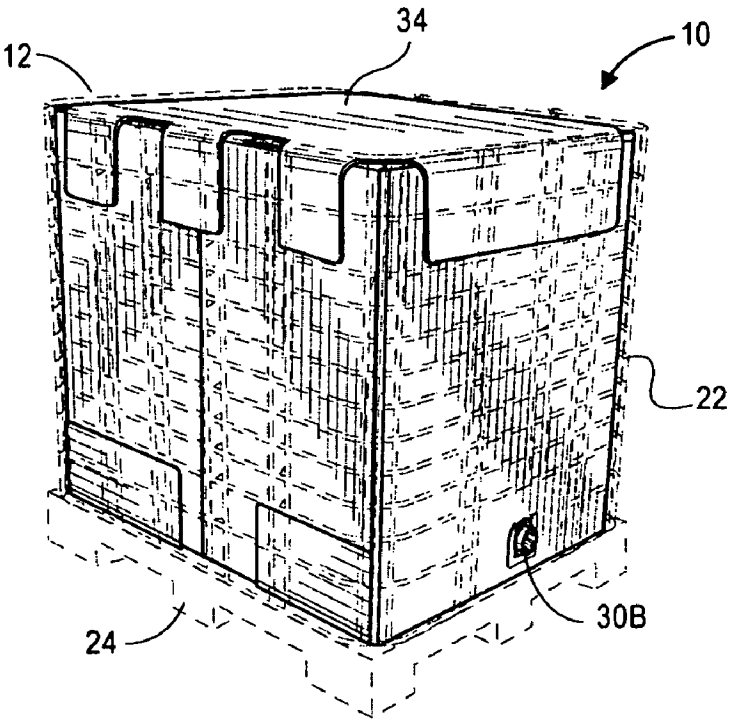
FIG. 16 is a perspective view of the liner cassette installed in the cage and covered with the cover according to the embodiment of FIG. 3.

FIG. 16 is a perspective view of the liner cassette 12 installed in the cage 22 and covered with the cover 34. As shown in FIG. 16, the tabs 42A to 42H may be slid between the box 18 and the cage 22.

Figure 17:
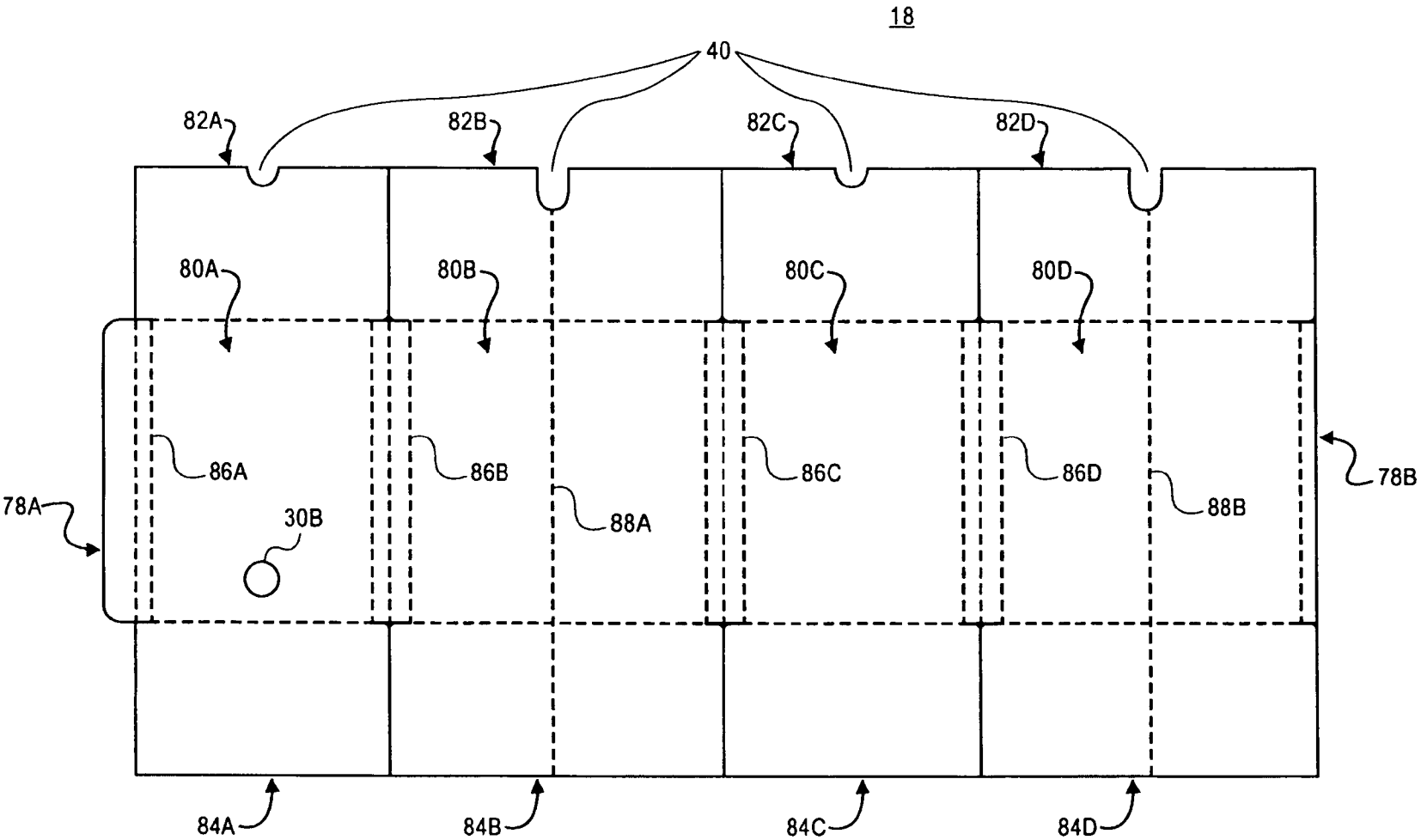
FIG. 17 is a plan view of the pre-cut and pre-scored blank suitable for use in a box according to another embodiment.

FIG. 17 is a plan view of the pre-cut and pre-scored blank suitable for use in the box 18 according to another embodiment. As shown in FIG. 17, the box 18 may be generated from a unitary piece of sheet stock. The box 18 may include a glue tab 78A configured to be glued to a corresponding glue area 78B. The box 18 further includes side panels 80A to 80D, top panels 82A to 82D, and bottom panels 84A to 84D.

The box 18 optionally includes fold zones 86A to 86D. If included, the fold zones 86A to 86D may bend along various curvatures. In addition, the fold zones 86A to 86D may fold in an accordion-like manner to accommodate variability in the size of the cage 22. The box 18 may further include pre-scored fold lines 88A and 88B to facilitate collapsing the box 18 as shown in FIG. 18.

Figure 18:
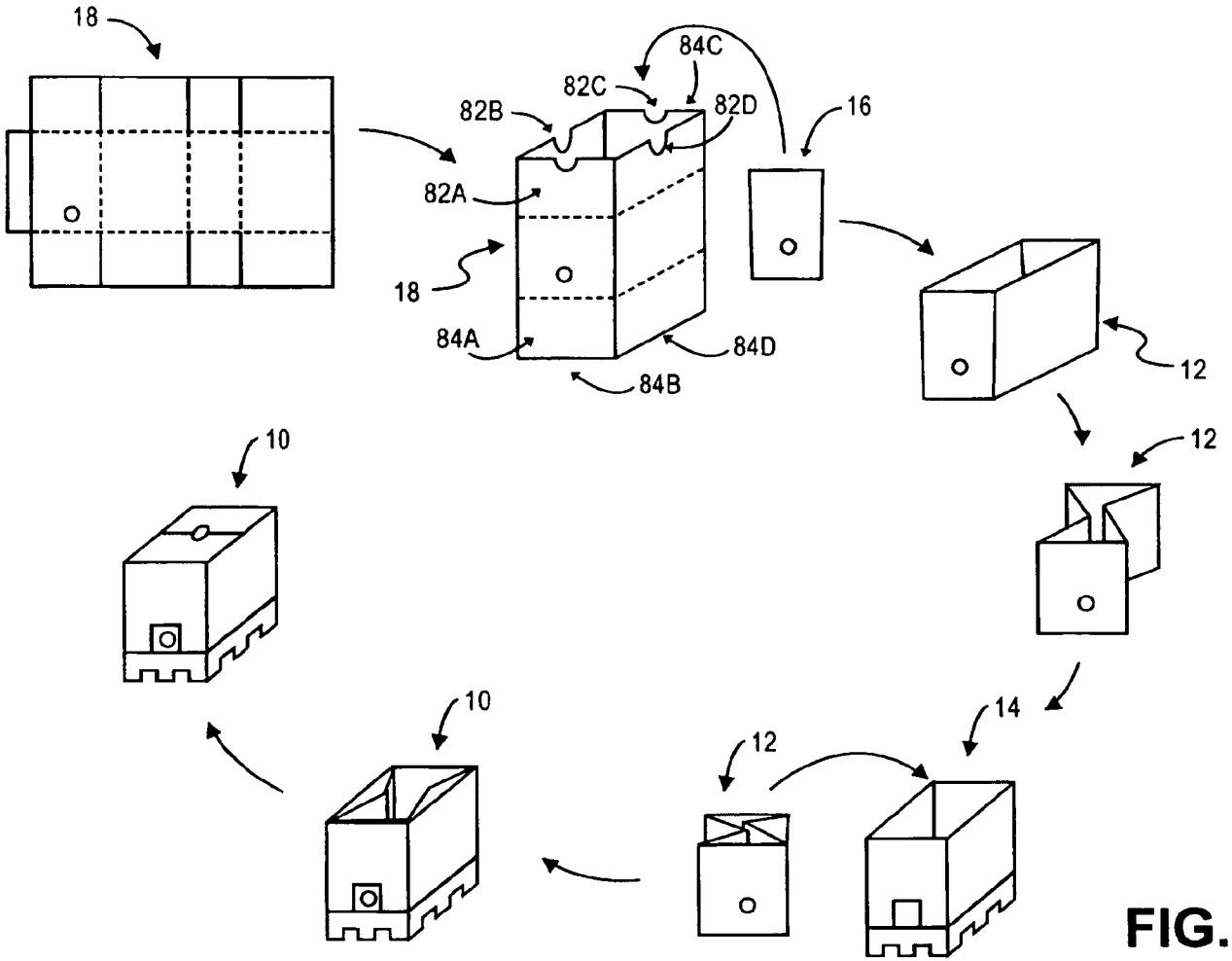
FIG. 18 is a series of simplified illustrations showing steps suitable for installing the liner cassette according to the embodiment of FIG. 17.

FIG. 18 show steps suitable for installing the liner cassette 12 according to the embodiment of FIG. 17 in the cage 22. As shown in FIG. 18, a pre-cut and pre-scored blank similar to the blank shown in FIG. 17 may be utilized to generate the box 18. As shown in step 1, the blank is fabricated into an open box. To this open box, the liner 16 may be added. As shown in step 2, the top panels 82A to 82D are folded inward and into the interior of the box 18. The bottom panels 84A to 84D are also inwardly folded into the interior of the box 18. As shown in step 3, the side of the box 18 are folded inward along fold lines 88A and 88B shown in FIG. 17. In this manner, the liner cassette 12 may be collapsed or "flat-packed." The flat-packed liner cassette 12 greatly facilitates storage and transportation of the liner cassette 12. Furthermore, the flat-packed liner cassette 12 facilitates assembly of the IBC liner packing system 10 without removal of top straps or bars that typically extend across the top of the cage 22. That is, the flat backed liner cassette 12 may be slid or otherwise inserted into the cage 22 between the top straps and assembled therein.

To assemble the IBC liner packaging system 10, the liner cassette 12 is disposed within the cage 22 of the IBC 14 and expanded by urging the side panels 80A to 80D (shown in FIG. 17) outwards. The bottom may be assembled by folding the bottom panels 84A to 84D (shown in FIG. 17) downwards. To assemble the top, liner 16 may be unfolded and the spout 30A may be disposed centrally within the cage 22. As the top panels 82A to 82D are outwardly and upwardly unfolded, the spout 30A may be disposed at the intersection of the top panels 82A to 82D and captured by the spout access 40 (shown in FIG. 17).

Figure 19:
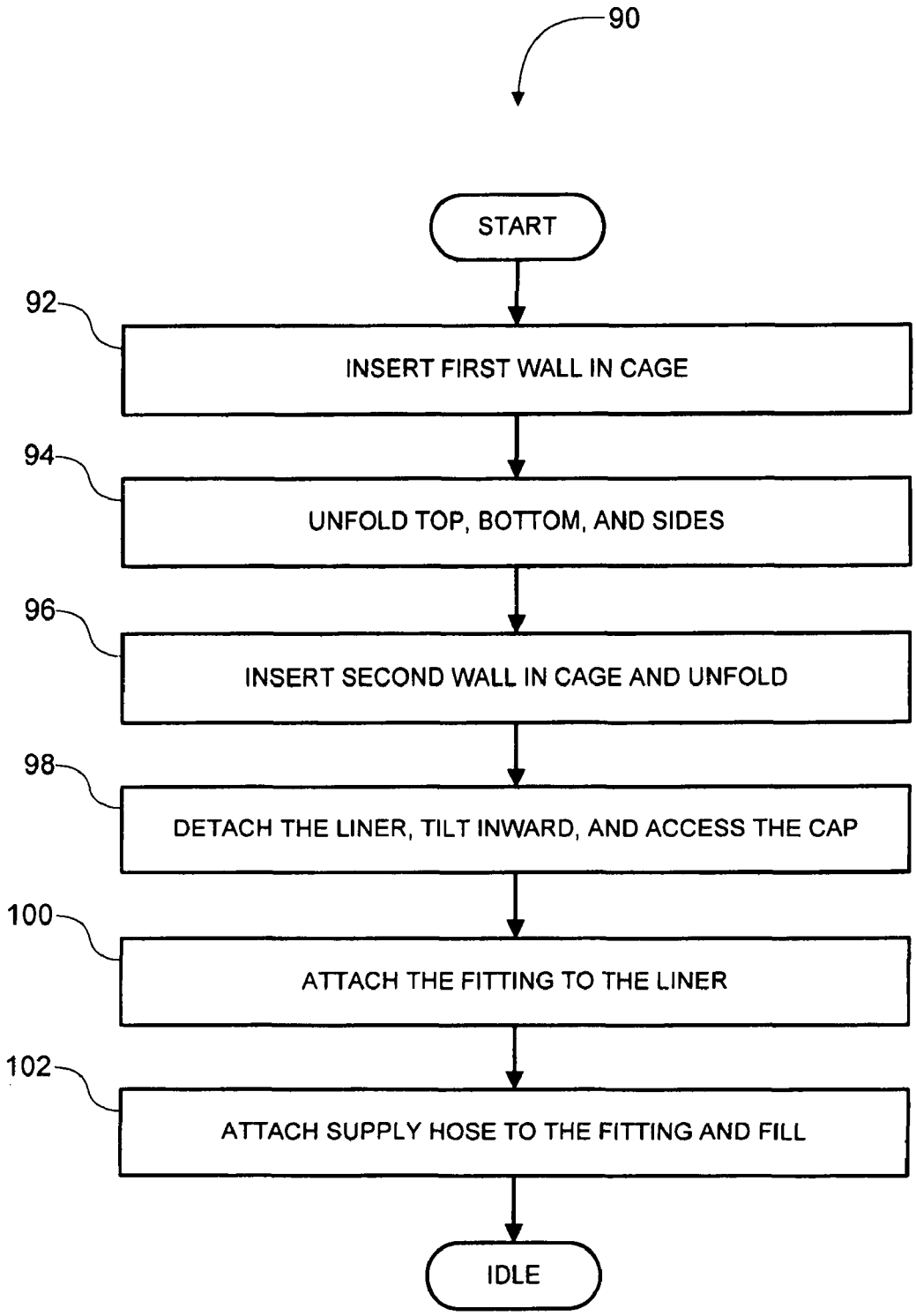
FIG. 19 is a flow diagram of a method of installing a liner cassette in a cage of the IBC according to an embodiment of the invention.

FIG. 19 is a flow diagram of a method 90 for installing the liner cassette 12 in the cage 22 of the IBC 14 according to an embodiment of the invention. For illustrative purposes, some steps of the method 90 are depicted in FIGS. 11 to 16 and/or FIG. 18. The method 90 is initiated at step 92 in response to inserting a first wall unit of the liner cassette 12 into the cage 22.

At step 94, a top flap is folded back, a bottom portion is folded down, and side portions are folded out into the cage 22 as shown in FIG. 12.

At step 96, as shown in FIG. 13, a second wall unit is inserted into the cage 22 and unfolded in a manner similar to the step 94.

At step 98, the liner 16 is detached from a sidewall and folded inward and downward. Optionally, the fitting 20*a* may be accessed to fill the packaging system. Alternatively, a cap may be accessed.

At step 100, the cap is optionally removed to facilitate installation of the fitting 20*a*.

At step 102, a supply hose may be attached to the fitting 20*a* and the packaging system 10 may be filled.

Following the method 90, the contents of the packaging system may be discharged.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A liner cassette to line a cage of an intermediate bulk container, the liner cassette comprising:

a liner comprising:

an envelope to contain a product; and a spout to provide access to the envelope; and a box including a set of sheet stock panels, the box comprising:

a bottom panel;

a plurality of side panels, the plurality of side panels comprising:

a first side unit comprising a pre-cut and pre-scored blank, wherein a first plurality of sub-panels are generated in response to folding the first side unit along the pre-score; and a second side unit comprising a pre-cut and pre-scored blank, wherein a second plurality of sub-panels are generated in response to folding the second side unit along the pre-score and, wherein a side of the box is generated in response to overlapping a sub-panel from the first plurality of sub-panels with a sub-panel from the second plurality of sub-panels;

a plurality of fold zones to conform to a radiused edge disposed between two side panels of the plurality of side panels; and a spout access disposed in a panel of the plurality of side panels; and wherein the liner cassette includes a first conformation and a second conformation, the first conformation being substantially flat with the set of sheet stock panels folded one upon the other and the liner being disposed between the folded set of sheet stock panels, the second conformation being substantially conformal to an interior of the cage.

2. The liner cassette according to claim 1, further comprising:

a bottom unit comprising a pre-cut and pre-scored blank, wherein a set of bottom sub-panels are generated in response to folding the bottom unit along the pre-score.

3. The liner cassette according to claim 2, wherein the liner is disposed upon the bottom unit and at least one of the set of bottom sub-panels are folded over the liner.

4. The liner cassette according to claim 1, further comprising:

a cover comprising a pre-cut and pre-scored blank, wherein a set of cover tabs are generated in response to folding the cover along the pre-score.

5. The liner cassette according to claim 4, wherein the set of cover tabs are configured to be inserted between the cage and the box to affix the cover to the box.

6. The liner cassette according to claim 4, further comprising:

a cover spout access panel to access top spout in the liner.

7. A packaging system comprising:

an intermediate bulk container comprising:

a cage having a set of walls and a floor; and a liner cassette to line the cage, the liner cassette comprising:

a liner comprising:

an envelope to contain a product; and a spout to provide access to the envelope; and a box including a set of sheet stock panels, the box comprising:

a bottom panel;

a plurality of side panels, the plurality of side panels comprising:

a first side unit comprising a pre-cut and pre-scored blank, wherein a first plurality of sub-panels are generated in response to folding the first side unit along the pre-score; and a second side unit comprising a pre-cut and pre-scored blank, wherein a second plurality of sub-panels are generated in response to folding the second side unit along the pre-score and, wherein a side of the box is generated in response to overlapping a sub-panel from the first plurality of sub-panels with a sub-panel from the second plurality of sub-panels;

a plurality of fold zones to conform to a radiused edge disposed between two side panels of the plurality of side panels; and a spout access disposed in a panel of the plurality of side panels; and wherein the liner cassette includes a first conformation and a second conformation, the first conformation being substantially flat with the set of sheet stock panels folded one upon the other and the liner being disposed between the folded set of sheet stock panels, the second conformation being substantially conformal to an interior of the cage.

8. The packaging system according to claim 7, further comprising:

a bottom unit comprising a pre-cut and pre-scored blank, wherein a set of bottom sub-panels are generated in response to folding the bottom unit along the pre-score.

9. The packaging system according to claim 8, wherein the liner is disposed upon the bottom unit and at least one of the set of bottom sub-panels are folded over the liner.

10. The packaging system according to claim 7, further comprising:

a cover comprising a pre-cut and pre-scored blank, wherein a set of cover tabs are generated in response to folding the cover along the pre-score.

11. The packaging system according to claim 10, wherein the set of cover tabs are configured to be inserted between the cage and the box to affix the cover to the box.

12. The packaging system according to claim 10, further comprising:

a cover spout access panel to access top spout in the liner.

13. The packaging system according to claim 7, further comprising:

a pallet disposed below the cage to support the packaging system and provide a lifting surface for the packaging system.

14. A method of replacing a liner cassette in a cage of an intermediate bulk container, the method comprising:

disposing a flat-packed liner cassette in the cage, the liner cassette comprising:

a liner comprising:

an envelope to contain a product; and a spout to provide access to the envelope; and a box including a set of sheet stock panels, the box comprising:

a bottom panel;

a plurality of side panels, the plurality of side panels comprising:

a first side unit comprising a pre-cut and pre-scored blank, wherein a first plurality of sub-panels are generated in response to folding the first side unit along the pre-score; and a second side unit comprising a pre-cut and pre-scored blank, wherein a second plurality of sub-panels are generated in response to folding the second side unit along the pre-score and, wherein a side of the box is generated in response to overlapping a sub-panel from the first plurality of sub-panels with a sub-panel from the second plurality of sub-panels;

a plurality of fold zones to conform to a radiused edge disposed between two side panels of the plurality of side panels; and a spout access disposed in a panel of the plurality of side panels; and wherein the liner cassette includes a first conformation and a second conformation, the first conformation being substantially flat with the set of sheet stock panels folded one upon the other and the liner being disposed between the folded set of sheet stock panels, the second conformation being substantially conformal to an interior of the cage; and unfolding the flat-packed liner cassette to substantially conform to the interior of the cage.

15. The method according to claim 14, further comprising:

disposing a side unit in the cage; and unfolding the side unit to substantially conform to at least one side of the interior of the cage.

16. The method according to claim 14, further comprising:

disposing a bottom unit in the cage; and unfolding the bottom unit to substantially conform to a portion of a bottom of the interior of the cage.

* * * * *